US005548680A

United States Patent [19]

Cellario

[11] Patent Number: 5,548,680

[45] Date of Patent: Aug. 20, 1996

[54] METHOD AND DEVICE FOR SPEECH SIGNAL PITCH PERIOD ESTIMATION AND CLASSIFICATION IN DIGITAL SPEECH CODERS

[75] Inventor: Luca Cellario, Turin, Italy

[73] Assignee: SIP-Societa Italiana per l'Esercizio Delle Telecomunicazioni P.A., Turin, Italy

[21] Appl. No.: 243,295

[22] Filed: May 17, 1994

[30] Foreign Application Priority Data

Jun. 10, 1993 [IT] Italy ..... TO93A0419

[51] Int. Cl.[6] ..... G10L 3/02

[52] U.S. Cl. ..... 395/2.28; 395/2.16; 395/2.17; 395/2.29; 395/2.71; 381/38

[58] Field of Search ..... 395/2.25–2.34, 395/2.71–2.73, 2.16, 2.17; 381/36–40

[56] References Cited

U.S. PATENT DOCUMENTS

| | | | |
|---|---|---|---|
| 5,208,862 | 5/1993 | Ozawa et al. | 381/36 |
| 5,233,660 | 8/1993 | Chen | 395/2.31 |
| 5,359,696 | 10/1994 | Gerson et al. | 395/2.32 |

FOREIGN PATENT DOCUMENTS

| | | | |
|---|---|---|---|
| 0443548 | 8/1991 | European Pat. Off. | G10L 9/14 |
| 0476614 | 3/1992 | European Pat. Off. | G10L 9/18 |
| 0500094 | 8/1992 | European Pat. Off. | G10L 9/14 |
| 0532225 | 3/1993 | European Pat. Off. | G10L 5/00 |

OTHER PUBLICATIONS

"Variable Rate Speech Coding With Online Segmention and Fast Algebraic Codes", R. DiFrancesco et al; S4b.5; pp. 233–236; CH2847–2/90/000–0233, 1990 IEEE.

*Primary Examiner*—Kee Mei Tung
*Attorney, Agent, or Firm*—Herbert Dubno

[57] ABSTRACT

A method and a device for speech signal digital coding are provided where at each frame there is carried out a long-term analysis for estimating pitch period d and a long- term prediction coefficient b and gain G, and an a-priori classification of the signal as active/inactive and, for active signal, as voiced/unvoiced. Period estimation circuits (LT1) compute such period on the basis of a suitably weighted covariance function, and classification circuits (RV) distinguish voiced signals from unvoiced signals by comparing long-term prediction coefficient and gain with frame-by-frame variable thresholds.

13 Claims, 2 Drawing Sheets

METHOD AND DEVICE FOR SPEECH SIGNAL PITCH PERIOD ESTIMATION AND CLASSIFICATION IN DIGITAL SPEECH CODERS

SPECIFICATION FIELD OF THE INVENTION

The present invention relates to digital speech coders and more particularly it concerns a method and a device for speech signal pitch period estimation and classification in digital speech coders.

BACKGROUND OF THE INVENTION

Speech coding systems yielding a high quality of coded speech at low bit rates are of increased interest of late. For this purpose linear prediction coding (LPC) techniques are usually used, these techniques exploiting spectral speech characteristics and allow coding only of the preceptually important information. Many coding systems based on LPC techniques perform a classification of the speech signal segment under processing for distinguishing whether it is an active or an inactive speech segment and, in the first case, whether it corresponds to a voiced or unvoiced sound. This allows coding strategies to be adapted to the specific segment characteristics. A variable coding strategy, where transmitted information changes from segment to segment, is particularly suitable for variable rate transmission, or, in case of fixed rate transmissions, allows exploiting possible reductions in the quantity of information to be transmitted for improving protection against channel errors.

An example of variable rate coding system in which a recognition of activity and silence periods is carried out and, during the activity periods, the segments corresponding to voiced or unvoiced signals are distinguished and coded in different ways, is described in the paper "Variable Rate Speech Coding with online segmentation and fast algebraic codes" by R. Di Francesco et alii, conference ICASSP '90, 3–6 April 1990, Albuquerque (USA), paper S2b.5.

SUMMARY OF THE INVENTION

According to the invention a method is supplied for coding a speech signal, in which method the signal to be coded is divided into digital sample frames containing the same number of samples; the samples of each frame are subjected to long-term predictive analysis to extract from the signal a group of parameters comprising a delay d corresponding to the pitch period, a prediction coefficient b, and a prediction gain G, and to a classification which indicates whether the frame itself corresponds to an active or inactive speech signal segment. In the case of an active signal segment, the classification indicates whether the segment corresponds to a voiced or an unvoiced sound, a segment being considered as voiced if both the prediction coefficient and the prediction gain are higher than or equal to respective thresholds. Coding units are supplied with information about these parameters, for a possible insertion into a coded signal, and with classification-related signals for selecting in said units different coding ways according to the characteristics of the speech segment. According to the invention during the long-term analysis the delay is estimated as a maximum of the covariance function, weighted with a weighting function which reduces the probability that the computed period is a multiple of the actual period, inside a window with a length not lower than a maximum admissible value for the delay itself. The thresholds for the prediction coefficient and gain are thresholds which are adapted at each frame, in order to follow the trend of the background noise and not of the voice.

A coder performing the method comprises means for dividing a sequence of speech signal digital samples into frames made up of a preset number of samples; means for speech signal predictive analysis, comprising circuits for generating parameters representative of short-term spectral characteristics and a short-term prediction residual signal, and circuits which receive the residual signal and generate parameters representative of long-term spectral characteristics, comprising a long-term analysis delay or pitch period d, and a long-term prediction coefficient b and gain G; and means for a-priori classification, which recognize whether a frame corresponds to a period of active speech or silence and whether a period of active speech corresponds to a voiced or unvoiced sound, and comprise circuits which generate a first and a second flag for signalling an active speech period and respectively a voiced sound, the circuits generating the second flag including means for comparing prediction coefficient and gain values with respective thresholds and for issuing that flag when both said values are not lower than the thresholds; speech coding units which generate a coded signal by using at least some of the parameters generated by the predictive analysis means, and which are driven by the flags so as to insert into the coded signal different information according to the nature of the speech signal in the frame. The circuits determining long-term analysis delay compute said delay by maximizing the covariance function of the residual signal, this function being computed inside a sample window with a length not lower than a maximum admissible value for the delay and being weighted with a weighting function such as to reduce the probability that the maximum value computed is a multiple of the actual delay. The comparison means in the circuits generating the second flag carry out the comparison with frame-by-frame variable thresholds and are associated with generating means for these thresholds, the threshold comparing and generating means being enabled in the presence of the first flag.

BRIEF DESCRIPTION OF THE DRAWING

The foregoing and other characteristics of the present invention will be made clearer by reference to the following annexed drawing in which.

SPECIFIC DESCRIPTION

Figure 1:
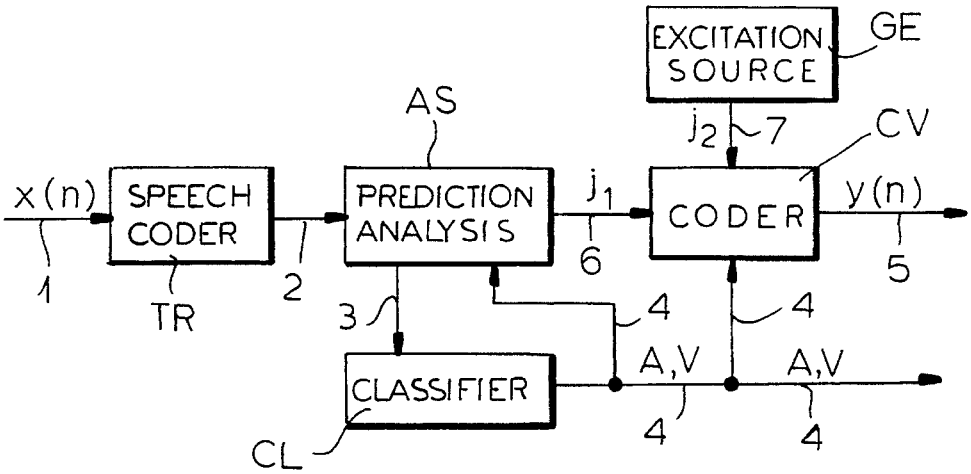
FIG. 1 is a basic diagram of a coder with a-priori classification using the invention.

FIG. 1 shows that a speech coder with a-priori classification can be schematized by a circuit TR which divides the sequence of speech signal digital samples x(n) present on connection 1, into frames made up of a preset number Lf of samples (e.g. 80–160, which at a conventional sampling rate of 8 KHz correspond to 10–20 ms of speech). The frames are provided, through a connection 2, to prediction analysis units AS which, for each frame, compute a set of parameters which provide information about short-term spectral characteristics (linked to the correlation between adjacent samples, which originates a non-flat spectral envelope) and about long-term spectral characteristics (linked to the correlation between adjacent pitch periods, from which the fine spectral structure of the signal depends). These parameters are provided by AS, through connection 3, to a classification unit CL, which recognizes whether the current frame corresponds to an active or inactive speech period and, in case of active speech, whether it corresponds to a voiced or unvoiced sound. This information is in practice made up of a pair of flags A, V, emitted on a connection 4, which can take up value 1 or 0 (e.g. A=1 active speech, A=0 inactive speech, and V=1 voiced sound, V=0 unvoiced sound). The flags are used to drive coding units CV and are transmitted also to the receiver. Moreover, as it will be seen later, the flag V is also fed back to the predictive analysis units to refine the results of some operations carried out by them.

Coding units CV generate coded speech signal y(n), emitted on a connection 5, starting from the parameters generated by AS and from further parameters, representative of information on excitation for the synthesis filter which simulates speech production apparatus; said further parameters are provided by an excitation source schematized by block GE. In general the different parameters are supplied to acting unit CV in the form of groups of indexes j1 (parameters generated by AS) and j2 (excitation). The two groups of indexes are present on connections 6, 7.

On the basis of flags A, V, units CV choose the most suitable coding strategy, taking into account also the coder application. Depending on the nature of sound, all information provided by AS and reaction analyzer excitation source GE or only a part of it will be entered in the coded signal. Certain indexes will be assigned preset values, etc. For example, in the case of inactive speech, the coded signal will contain a bit configuration which codes silence, e.g. a configuration allowing the receiver to reconstruct the so-called "comfort noise" if the coder is used in a discontinuous transmission system. In the case of unvoiced sound, the signal will contain only the parameters related to short-term analysis and not those related to long-term analysis, since in this type of sound there are no periodicity characteristics, and so on. The precise structure of units CV is of no interest for the invention.

Figure 2:
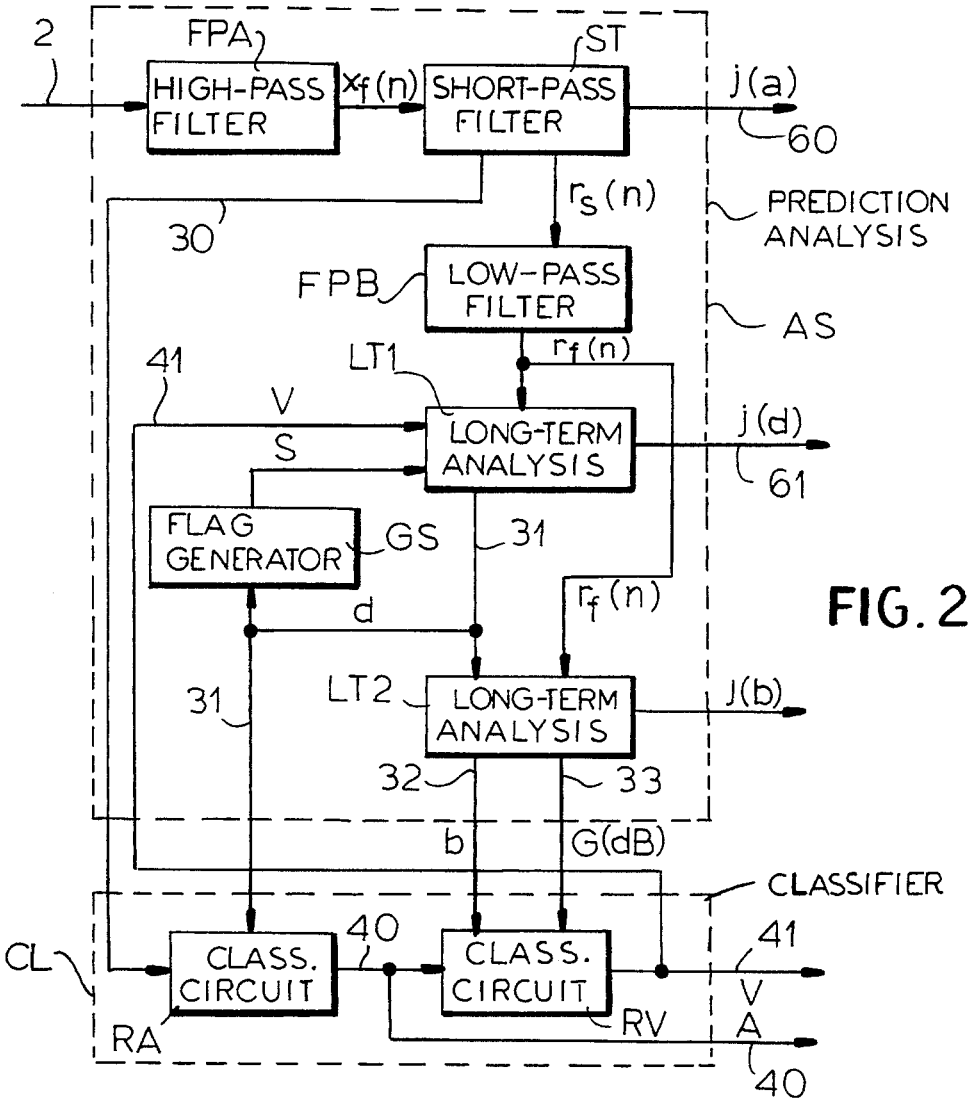
FIG. 2 is a more detailed diagram of some of the blocks in FIG. 1.

FIG. 2 shows in details the structure of blocks AS and CL.

Sample frames present on connection 2 are received by a high-pass filter FPA which has the task of eliminating d.c. offset and low frequency noise and generates a filtered signal $x_f(n)$ which is supplied to short-term analysis circuits ST, fully conventional, which comprise the units computing linear prediction coefficients $a_i$ (or quantities related to these coefficients) and short-term prediction filter which generates short-term prediction residual signal $r_s(n)$.

As usual, circuits ST provide coder CV (FIG. 1), through a connection 60, with indexes j(a) obtained by quantizing coefficients $a_i$ or other quantities representing the same.

Residual signal $r_s(n)$ is provided to a low-pass filter FPB, which generates a filtered residual signal $r_f(n)$ which is supplied to long-term analysis circuits LT1, LT2 estimating respectively pitch period d and long-term prediction coefficient b and gain G. Low-pass filtering makes these operations easier and more reliable, as a person skilled in the art knows.

Pitch period (or long-term analysis delay) d has values ranging between a maximum $d_H$ and a minimum $d_L$, e.g. 147 and 20. Circuit LT1 estimates period d on the basis of the covariance function of the filtered residual signal, said function being weighted, according to the invention, by means of a suitable window which will be later discussed.

Period d is generally estimated by searching the maximum of the autocorrelation function of the filtered residual $r_f(n)$ $$R(d) = \sum_{n=0}^{Lf-1-d} r_f(n+d) \cdot r_f(n) \qquad (d = d_L \ldots d_H) \tag{1}$$

This function is assessed on the whole frame for all the values of d. This method is scarcely effective for high values of d because the number of products of (1) goes down as d goes up and, if $d_H$>Lf/2, the two signal segments $r_f(n+d)$ and $r_f(n)$ may not consider a pitch period and so there is the risk that a pitch pulse may not be considered. This would not happen if the covariance function were used, which is given by relation $$\hat{R}(d,0) = \sum_{n=0}^{Lf-1} r_f(n-d) \cdot r_f(n) \qquad (d = d_L \ldots d_H) \tag{2}$$

where the number of products to be carried out is independent from d and the two speech segments $r_f(n-d)$ and $r_f(n)$ always comprise at least a pitch period (if $d_H$<Lf). Nevertheless, using the covariance function entails a very strong risk that the maximum value found is a multiple of the effective value, with a consequent degradation of coder performances. This risk is much lower when the autocorrelation is used, thanks to the weighting implicit in carrying out a variable number of products. However, this weighting depends only on the frame length and therefore neither its amount nor its shape can be optimized, so that either the risk remains or even submultiples of the correct value or spurious values below the correct value can be chosen. Keeping this into account, according to the invention, covariance $\hat{R}$ is weighted by means of a window $\hat{e}(d)$ which is independent from frame length, and the maximum of weighted function $$\hat{R}w(d)=\hat{w}(d) \quad \hat{R}(d,O) \tag{3}$$

is searched for the whole interval of values of d. In this way the drawbacks inherent both to the autocorrelation and to the simple covariance are eliminated. Hence the estimation of d is reliable in case of great delays and the probability of obtaining a multiple of the correct delay is controlled by a weighting function that does not depend on the frame length and has an arbitrary shape in order to reduce as much as possible this probability.

The weighting function, according to the invention, is:

$$\hat{w}(d)=d^{\log 2Kw} \tag{4}$$

where 0<Kw<1. This function has the property that $$\hat{w}(2d)/\hat{w}(d)=Kw, \tag{5}$$

that is the relative weighting between any delay d and its double value is a constant lower than 1. Low values of Kw reduce the probability of obtaining values multiple of the effective value. On the other hand too low values can give a maximum which corresponds to a submultiple of the actual value or to a spurious value, and this effect will be even worst. Therefore, value Kw will be a tradeoff between these exigencies: e.g. a proper value, used in a practical embodiment of the coder, is 0.7.

It should be noted that if delay $d_H$ is greater than the frame length, as it can occur when rather short frames are used (e.g. 80 samples), the lower limit of the summation must be Lf-$d_H$, instead of 0, in order to consider at least one pitch period.

Delay computed with (3) can be corrected in order to guarantee a delay trend as smooth as possible, with methods similar to those described in the Italian patent application No. TO 93A000244 filed on Apr. 9, 1993, (corresponding to commonly owned copending application Ser. No. 08/224,627 filed Apr. 6, 1994). This correction is carried out if in the previous frame the signal was voiced (flag V at 1) and if also a further flag S was active, which further flag signals a speech period with smooth trend and is generated by a circuit GS which will be described later.

To perform this correction a search of the local maximum of (3) is done in a neighbourhood of the value d(−1) related to the previous frame, and a value corresponding to the local maximum is used if the ratio between this local maximum and the main maximum is greater than a certain threshold. The search interval is defined by values $$d_L' = \max\,[(1-\Theta_s)d(-1),\ d_L]$$

$$d_H' = \min\,[(1+\Theta_s)d(-1),\ d_H]$$

where $\Theta_2$ is a threshold whose meaning will be made clearer when describing the generation of flag S. Moreover the search is carded on only if delay d(O) computed for the current frame with (3) is outside the interval $d'_L - d'_H$.

Block GS computes the absolute value $$|\Theta| = \frac{|d_m - d_{m-1}|}{d_{m-1}} \qquad m = Ld+1 \ldots 0$$

of relative delay variation between two subsequent frames for a certain number Ld of frames and, at each frame, generates flag S if $|\Theta|$ is lower than or equal to threshold $\Theta_s$ for all Ld flames. The values of Ld and $\Theta_s$ depend on Lf. Practical embodiments used values Ld=1 or Ld=2 respectively for frames of 160 and 80 samples; corresponding values of $\Theta_s$ were respectively 0.15 and 0.1.

Long-term analyzer LT1 sends to coder CV (FIG. 1), through a connection 61, an index j(d) (in practice $d-d_L+1$) and sends value d to classification circuits CL and to circuits LT2 which compute long-term prediction coefficient b and gain G. These parameters are respectively given by the ratios:

$$b = \frac{\hat{R}(d,0)}{\hat{R}(d,d)} \tag{7}$$

$$G = 1/\left(1 - b\frac{\hat{R}(d,0)}{\hat{R}(0,0)}\right) \tag{8}$$

where $\hat{R}$ is the covariance function expressed by relation (2). The observations made above for the lower limit of the summation which appears in the expression of $\hat{R}$ apply also for relations (7), (8). Gain G gives an indication of long-term predictor efficiency and b is the factor with which the excitation related to past periods must be weighted during coding phase. LT2 also transforms value G given by (8) into the corresponding logarithmic value $G(dB)=10\log_{10}G$, it sends values b and G(dB) to classification circuits Cl (through connections 32, 33) and sends to coder CV (FIG. 1), through a connection 62, an index j(b) obtained through the quantization of b. Connections 60, 61, 62 in FIG. 2 form all together the connection 6 in FIG. 1.

The appendix gives the listing in C language of the operations performed by LT1, GS, LT2. Starting from this listing, the skilled in the art has no problem in designing or programming devices performing the described functions.

Classification circuits comprise the series of two blocks RA, RV. The first has the task of recognizing whether or not the frame corresponds to an active speech period, and therefore of generating flag A, which is presented on a connection 40. Block RA can be of any of the types known in the art. The choice depends also on the nature of speech coder CV. For example block RA can substantially operate as indicated in the recommendation CEPT-CCH-GSM 06.32, and so it will receive from short-term analyzer ST and long-term analyzer LT1, through connections 30, 31, information respectively linked to linear prediction coefficients and to pitch period. As an alternative, block RA can operate as in the already mentioned paper by R. Di Francesco et alii.

Block RV, enabled when flag A is at 1, compares values b and G(dB) received from LT2 with respective thresholds $b_s$, Gs and generates flag V when b and G(dB) are greater than or equal to the thresholds. According to the present invention, thresholds $b_s$, Gs are adaptive thresholds, whose value is a function of values b and G(dB). The use of adaptive thresholds allows the robustness against background noise to be greatly improved. This is of basic importance especially in mobile communication system applications, and it also improves speaker-independence.

The adaptive thresholds are computed at each frame in the following way. First of all, actual values of b, G(dB) are scaled by respective factors Kb, KG giving values b'=Kb.b, G'=KG.G(dB). Proper values for the two constants Kb, KG are respectively 0.8 and 0.6. Values b' and G' are then filtered through a low-pass filter in order to generate threshold values $b_s(O)$, $G_s(O)$, relevant to current frame, according to relations:

$$b_s(O) = (1-\alpha)b' + \alpha b_s(-1) \tag{9'}$$

$$Gs(O) = (1-\alpha)G' + \alpha Gs(-1) \tag{9''}$$

where $b_s(-1)$, Gs(−1) are the values relevant to the previous frame and α is a constant lower than 1, but very near to 1. The aim of low-pass filtering, with coefficient a very near to 1, is to obtain a threshold adaptation following the trend of background noise, which is usually relatively stationary also for long periods, and not the trend of speech which is typically nonstationary. For example coefficient value a is chosen in order to correspond to a time constant of some seconds (e.g. 5), and therefore to a time constant equal to some hundreds of frames.

Values $b_s(O)$, $G_s(O)$ are then clipped so as to be within an interval $b_s(L)$—$b_s(H)$ and $G_s(L)$—Gs(H). Typical values for the thresholds are 0.3 and 0.5 for b and 1 dB and 2 dB for G(dB). Output signal clipping allows too slow returns to be avoided in case of limit situation, e.g. after a tone coding, when input signal values are very high. Threshold values are next to the upper limits or are at the upper limits when there is no background noise and as the noise level rises they tend to the lower limits.

Figure 3:
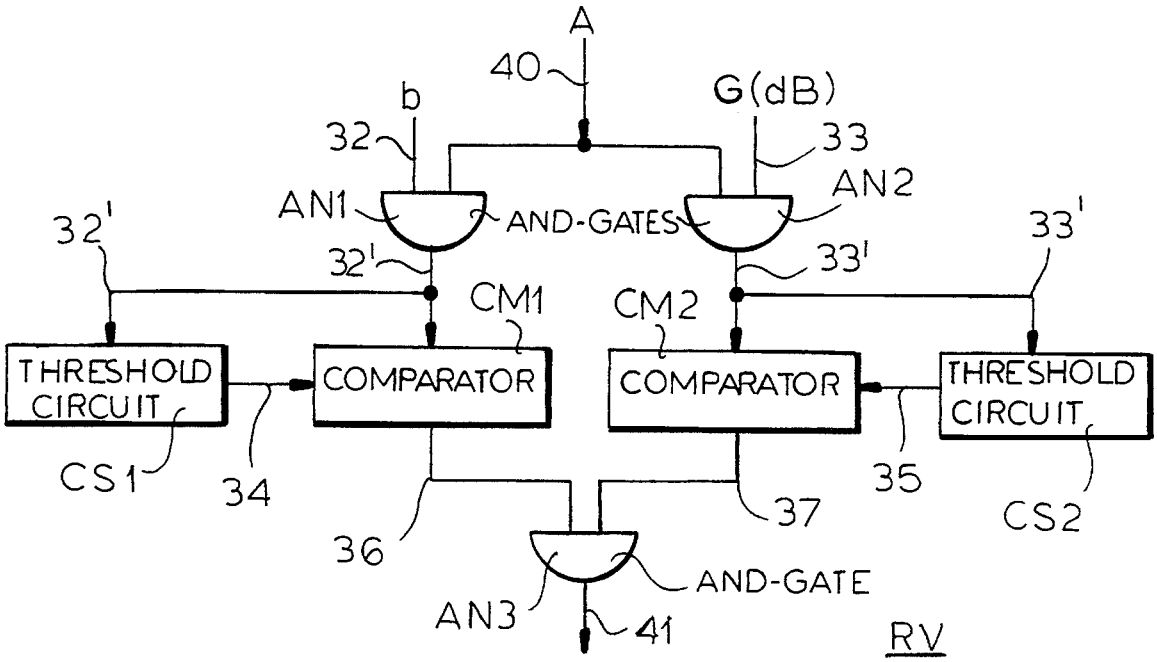
FIG. 3 is a diagram of the voicing detector.

FIG. 3 shows the structure of voicing detector RV. This detector essentially comprises a pair of comparators CM1, CM2, which, when flag A is at 1, respectively receive from long-term analyzer LT2 the values of b and G(dB), compare them with thresholds computed frame by frame and presented on wires 34, 35 by respective threshold generation circuits CS1, CS2, and emit on outputs 36, 37 a signal which indicates that the input value is greater than or equal to the threshold. AND gates AN1, AN2, which have an input connected respectively to wires 32 and 33, and the other input connected to wire 40, schematize enabling of circuits RV only in case of active speech. Flag V can be obtained as output signal of AND gate AN3, which receives at the two inputs the signals emitted by the two comparators.

Figure 4:
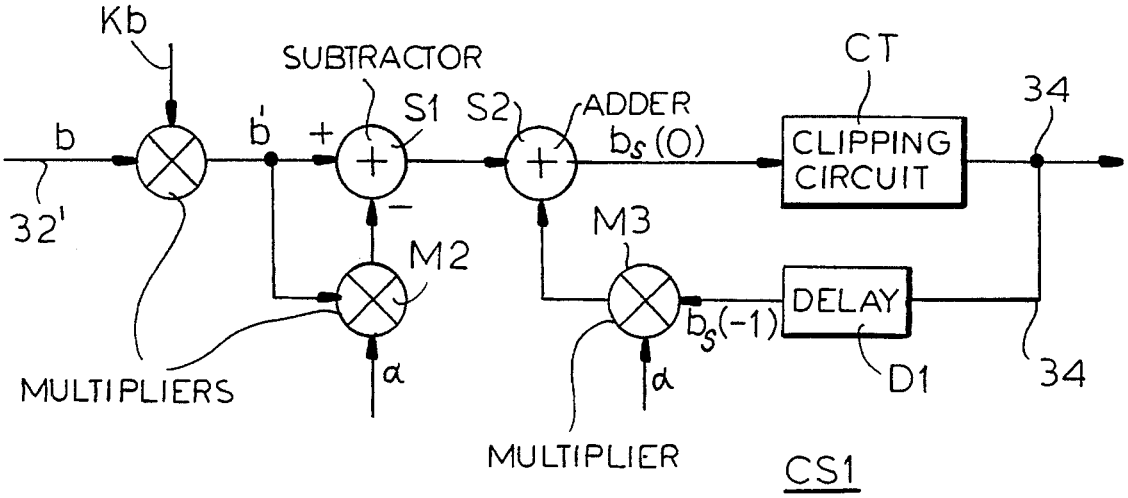
FIG. 4 is a diagram of the threshold computation circuit for the detector in FIG. 3.

FIG. 4 shows the structure of circuit CS1 for generating threshold $b_s$; the structure of CS2 is identical.

The circuit comprises a first multiplier M1, which receives coefficient b present on wires 32', scales it by factor Kb, and generates value b'. This is fed to the positive input of a subtracter S1, which receives at the negative input the output signal from a second multiplier M2, which multiplies value b' by constant α. The output signal of S1 is provided to an adder S2, which receives at a second input the output signal of a third multiplier M3, which performs the product between constant α and threshold $b_s(-1)$ relevant to the previous frame, obtained by delaying in a delay element D1, by a time equal to the length of a frame, the signal present on circuit output 36. The value present on the output of S2, which is the value given by (9'), is then supplied to clipping circuit CT which, if necessary, clips the value $b_s(O)$ so as to keep it within the provided range and emits the clipped value on output 36. It is therefore the clipped value which is used for filterings relevant to next frames.

APPENDIX

```
/* Search for the long-term predictor delay: */
Rwrfdmax=-DBL_MAX;
for (d_=dL; d_<=dH; d_++)
{
    Rrfd0=0.;
    for (n=Lf-dH; n<=Lf-1; n++)
     Rrfd0+=rf[n-d_]*rf[n];
     Rwrf[d_]=w_[d_]*Rrfd0;
    if (Rwrf[d_]>Rwrfdmax)
   {
     d[0]=d_;
     Rwrfdmax=Rwrf[d_];
   }
}
/* Secondary search for the long-term predictor delay around the
previous value: */
dL_=sround((1.-absTHETAdthr)*d[-1]);
dH_=sround((1.+absTHETAdthr)*d[-1]);
if (dL_<dL)
   dL_=dL;
else if (dH_>dH)
   dH_=dH;
if (smoothing[-1]&&voicing[-1]&&(d[0]<dL_|d[0]>dH_))
{
   Rwrfdmax_=-DBL_MAX;
    for (d_=dL_;d_<=dH_;d_++)
       if (Rwrf[d_]>Rwrfdmax_)
      {
     d_=d_;
     Rwrfdmax_=Rwrf[d_];
     }
    if (Rwrfdmax_/Rwrfdmax>=KRwrfdthr)
     d[0]=d_;
}
/* Smoothing decision: */
smoothing[0]=1;
for (m=-Lds+1; m<=0; m++)
    if (fabs(d[m]-d[m-1])/d[m-1]>absTHETAdthr)
     smoothing[0]=0;
/* Computation of the long-term predictor coefficient and gain */
Rrfdd=Rrfd0=Rrf00=0.;
for (n=Lf-dH; n<=Lf-1; n++)
{
     Rrfdd+=rf[n-d[0]]*rf[n-d[0]];
    Rrfd0+=rf[n-d[0]]*rf[n];
   Rrf00+=rf[n]*rf[n];
}
b=(Rrfdd>=epsilon)?Rrfd0/Rrfdd:0.;
GdB=(Rrfdd>=epsilon&&Rrf00>=epsilon)?-10.*log10(1.-
b*Rrfd0/Rrf00):0.;
```

I claim:

1. A method of speech signal coding, comprising the steps of:

(a) dividing a speech signal to be coded into digital sample frames each containing the same number of samples:

(b) subjecting the samples of each frame to a predictive analysis for extracting from said signal parameters representative of long-term and short-term spectral characteristics and comprising at least a long-term analysis delay d, corresponding to a pitch period, and a long-term prediction coefficient b and gain G, and to a classification which indicates whether a respective frame corresponds to an active or inactive speech signal segment and for an active signal segment, whether the segment corresponds to a voiced or an unvoiced sound, a segment being considered as voiced if a respective prediction coefficient and gain are both greater than or equal to respective thresholds;

(c) providing information on said parameters to coding units for insertion into a coded signal, together with signals indicative of the classification for selecting in said coding units different coding methods according to characteristics of respective speech segments; and (d) during said long-term analysis, estimating said delay is as a maximum of covariance function, weighted with a weighting function which reduces a probability that the period computed is a multiple of an actual period, inside a window with a length not less than a maximum value admitted for the delay, said thresholds for prediction coefficient and gain being thresholds which are adapted at each frame, in order to follow a background noise but not of the speech signal, adaptation of said thresholds being enabled only in active speech signal segments.

2. The method defined in claim 1 wherein said weighting function, for each value admitted for the delay is a function of the type $\hat{w}(d)=d^{log}2^{Kw}$, where d is the delay and Kw is a positive constant lower than 1.

3. The method defined in claim 1 wherein said covariance function for an entire frame, if a maximum admissible value for the delay is lower than a frame length, or for a sample window with length equal to said maximum delay and including the respective frame, if the maximum delay is greater than frame length.

4. The method defined in claim 3 wherein a signal indicative of pitch period smoothing is generated at each frame and, during said long-term analysis, if a signal in a previous frame was voiced and had a pitch smoothing, a search is carried out for a secondary maximum of the weighted covariance function in a neighborhood of a value found for the previous frame, and a value corresponding to this secondary maximum is used as the delay if it differs by a quantity lower than a preset quantity from the covariance function maximum in a current frame.

5. The method defined in claim 4 wherein for the generation of said signal indicative of pitch smoothing a relative delay variation between two consecutive frames is computed for a preset number of frames which precede the current frame; the absolute values of the relative delay variations are estimated; the absolute values so obtained are compared with a delay threshold; and the signal indicative of pitch period smoothing is generated if the absolute values are all greater than said delay threshold.

6. The method defined in claim 4 wherein a width of said neighborhood is a function of said delay threshold.

7. The method defined in claim 1 wherein for computation of said long-term prediction coefficient and gain thresholds in a frame, the prediction coefficient and gain values are scaled by respective preset factors; the thresholds obtained at a previous frame and scaled values for both the coefficient and the gain are subjected to low-pass filtering, with a first filtering coefficient, able to originate a very long time constant compared with a frame duration, and respectively with a second filtering coefficient, which is a 1—complement of the first filter coefficient; and the scaled and filtered values of the prediction coefficient and gain are added to a respective filtered threshold, a value resulting from the addition being a threshold updated value.

8. The method defined in claim 7 wherein the threshold values resulting from addition are clipped with respect to a maximum and a minimum value, and in a successive frame a value so clipped is subjected to low-pass filtering.

9. A device for speech signal digital coding, comprising:

means (TR) for dividing a sequence of speech signal digital samples into frames made up of a preset number of samples;

means for speech signal predictive analysis (AS), comprising circuits (ST) for generating at each frame, parameters representative of short-term spectral characteristics and a residual signal of short-term prediction, and circuits (LT1, LT2) which obtain from the residual signal parameters representative of long-term spectral characteristics comprising a long-term analysis delay or pitch period d, and a long-term prediction coefficient b and a gain G:

means for a-priori classification (CL) for recognizing whether a frame corresponds to an active speech period or to a silence period and whether an active speech period corresponds to a voiced or an unvoiced sound, the classification means (CL) comprising circuits (RA, RV) which generate a first and a second flag (A, V) for respectively signalling an active speech period and a voiced sound, and the circuits generating the second flag comprising means (CM1, CM2) for comparing the prediction coefficient and gain values with respective thresholds and emitting this flag when said values are both greater than the thresholds; and speech coding units (CV), which generate a coded signal by using at least some of the parameters generated by the predictive analysis means (AS), and are driven by said flags (A, V) in order to insert into the coded signal different information according to the nature of the speech signal in the frame, the circuits (LT1) for delay estimation computing said delay by maximizing a covariance function of a residual signal, computed inside a sample window with a length not lower than a maximum admissible value for the delay itself and weighted with a weighting function such as to reduce the probability that the maximum value computed is a multiple of the actual delay, and said comparison means (CM1, CM2) in the circuits (RV) generating the second flag (V) carrying out the comparison frame by frame with variable thresholds and being provided with means (CS1, CS2) for threshold generation, the comparison and threshold generation means being enabled only in the presence of the first flag.

10. The device defined in claim 9 wherein said weighting function, for each admitted value of the delay, is a function of the type $\hat{w}(d)=d^{\log 2^{Kw}}$, where d is the delay and Kw is a positive constant lower than 1.

11. The device defined in claim 9 wherein long-term analysis delay computing circuits (LT1) are associated with means (GS) for recognizing a frame sequence with delay smoothing, and generating and providing said long-term analysis delay computing circuits (LT1) with a third flag (S) if, in said frame sequence, an absolute value of the relative delay variation between consecutive frames is always lower than a preset delay threshold.

12. The device defined in claim 11 wherein the delay computing circuits (LT1) carry out a correction of a delay value computed in a frame if in a previous frame the second and the third flags (V, S) were issued, and provide, as value to be used, a value corresponding to a secondary maximum of the weighted covariance function in a neighborhood of the delay value computed for the previous frame, if this maximum is greater than a preset fraction of the main maximum.

13. The device defined in claim 11 wherein the circuits (CS1, CS2) generating the prediction coefficient and gain thresholds comprise:

a first multiplier (M1) for scaling a coefficient or a gain by a respective factor:

a low-pass filter (S1, M2, D1, M3) for filtering the threshold computed for a previous frame and a scaled value, respectively according to a first filtering coefficient corresponding to a time constant with a value much greater than a length of a frame and to a second coefficient which is a ones complement of the first coefficient;

an adder (S2) which provides a current threshold value as a sum of the filtered signals; and a clipping circuit (CT) for keeping a threshold value within a preset value interval.

* * * * *